US007621151B2

(12) United States Patent
Ohta

(10) Patent No.: US 7,621,151 B2
(45) Date of Patent: Nov. 24, 2009

(54) PRESSURE CONTROL VALVE

(75) Inventor: Hiromi Ohta, Okazaki (JP)

(73) Assignee: Denso Corporation, Kariya (JP)

( * ) Notice: Subject to any disclaimer, the term of this patent is extended or adjusted under 35 U.S.C. 154(b) by 265 days.

(21) Appl. No.: 11/732,472

(22) Filed: Apr. 3, 2007

(65) Prior Publication Data

US 2007/0227183 A1 Oct. 4, 2007

(30) Foreign Application Priority Data

Apr. 4, 2006 (JP) ..... 2006-103485

(51) Int. Cl.
*F25B 41/06* (2006.01)

(52) U.S. Cl. ..... 62/527; 62/511

(58) Field of Classification Search ..... 62/222, 62/511, 513, 527, 528; 257/146, 149.8
See application file for complete search history.

(56) References Cited

U.S. PATENT DOCUMENTS 3,581,759 A * 6/1971 Veale ..... 137/101.19
4,501,290 A * 2/1985 Sturman et al. ..... 137/495
6,189,326 B1 2/2001 Tomatsu et al.
2006/0150650 A1 * 7/2006 Murase et al. ..... 62/222

FOREIGN PATENT DOCUMENTS

JP 2002-013844 1/2002

* cited by examiner

*Primary Examiner*—Melvin Jones
(74) *Attorney, Agent, or Firm*—Harness, Dickey & Pierce, PLC

(57) ABSTRACT

A pressure control valve has a temperature sensing portion. The temperature sensing portion includes a diaphragm and a cap member. A peripheral portion of the diaphragm is fixed to a peripheral portion of the cap member. One surface of the diaphragm and the cap member define a sealed space in which gas is airtightly filled. The other surface of the diaphragm is fixed to one end of the valve body, and subjected to fluid in a fluid chamber. A change of the temperature of the fluid changes a volume of the gas in the sealed space to displace the diaphragm and the valve body to open and close a valve port. A reinforcement member reinforces a fixture of the cap member to the diaphragm.

13 Claims, 11 Drawing Sheets

PRESSURE CONTROL VALVE

CROSS REFERENCE TO RELATED APPLICATION

This application is based upon and claims the benefit of priority of Japanese Patent Application No. 2006-103485 filed on Apr. 4, 2006, the content of which is incorporated herein by reference.

FIELD OF THE INVENTION

The present invention relates to a pressure control valve (expansion valve) that controls a fluid pressure in accordance with a fluid temperature. The present invention especially relates to the pressure control valve that controls a refrigerant pressure at an outlet side of a radiator (gas cooler) in a vapor-compression refrigeration cycle in accordance with a refrigerant temperature at the outlet side of the radiator. The pressure control valve is preferably applicable to a refrigeration cycle using a refrigerant, a working pressure of which reaches supercritical phase, such as carbon dioxide ($CO_2$).

BACKGROUND OF THE INVENTION

JP-2002-13844-A, and JP-2000-81157-A having counterparts U.S. Pat. No. 6,189,326 and EP-0971184-B1 disclose pressure control valves that are preferably applicable to a vapor-compression refrigeration cycle for an air conditioning system for a vehicle.

As shown in FIG. 11, the pressure control valve according to JP-2002-13844-A is applied in a refrigeration cycle having a closed circuit that is composed of a compressor 1, a condenser (gas cooler) 2, a receiver (gas-liquid separator) 9, an expansion valve (pressure control valve) 103 and an evaporator 4, to circulate HFC-134a refrigerant therein. The pressure control valve 103 has a temperature sensing portion 130 that is formed by sandwiching a peripheral portion of a film-shaped diaphragm 131 between a first housing (cap member) 132 and a second housing (flange member) 133 so that the diaphragm 131 bulges in accordance with a variation of a pressure in a temperature sensing chamber S. Peripheral portions of these three members 131, 132, 133 are welded to each other, and the second housing 132 is fixed on a main body 134 of the pressure control valve 103. Above-mentioned construction of the temperature sensing portion 130 endures well in a case in which a refrigerant having a relatively low working pressure (e.g. HFC-134a) circulates, and the diaphragm 131 is subjected to a relatively low refrigerant pressure at an outlet side of the evaporator 4. In this regard, in a $CO_2$ refrigeration cycle in which $CO_2$ refrigerant circulates, it is necessary to keep the refrigerant pressure in a high pressure range in accordance with a refrigerant temperature at an outlet side of the gas cooler (radiator), in order to maximize a coefficient of performance (COP). If the pressure control valve 103 is applied in the $CO_2$ refrigeration cycle, the diaphragm 131 is subjected to the high pressure at the outlet side of the gas cooler 2. The above-mentioned construction of the temperature sensing portion 130 does not endure this high refrigerant pressure, and the pressure control valve 103 is not suitable for a use in the $CO_2$ refrigeration cycle.

As shown in FIG. 12, the pressure control valve according to JP-2000-81157-A (U.S. Pat. No. 6,189,326, EP-0971184-B1) is applied in a refrigeration cycle having a closed circuit that is composed of a compressor 1, a gas cooler (radiator) 2, a pressure control valve 203, an evaporator 4, an accumulator 5 and an internal heat exchanger 8, to circulate $CO_2$ refrigerant therein. The pressure control valve 203 has a temperature sensing portion 230 that is formed by bending a peripheral portion of the diaphragm 231 generally into a right angle to provide a bent portion 231*a* as shown in FIG. 11, fitting the bent portion 231*a* of the diaphragm 231 between a diaphragm cover (cap member) 232 and a diaphragm support (flange member) 233, and welding these three members 231, 232, 233 at a rim portion of the bent portion 231*a*.

However, a construction of the temperature sensing portion 230 of the pressure control valve 203 has the following disadvantages.

(1) The diaphragm 231 must be made of a material having a relatively high strength such as precipitation hardening stainless steel, in order to secure enough endurance for working. As mentioned above, $CO_2$ refrigerant has a relatively high working pressure with respect to the working pressure of the conventional HFC-134a refrigerant. Thus, the pressure control valve 203 according to JP-2000-81157-A (U.S. Pat. No. 6,189,326, EP-0971184-B1) secures sufficiently large burst pressure, by using the diaphragm 231 having relatively large thickness and by bending the peripheral portion of the diaphragm 231 into an L-shape.

In this construction, however, the diaphragm 231, which has a relatively large strength, is bent, so that an elastic restoration of the diaphragm 231 distorts in a proximity of the bent portion 231*a*, to deteriorate flatness of the diaphragm 231. Thus, when the diaphragm 231 is fitted to the diaphragm cover 232 and to a diaphragm support 233, a gap is generated between the diaphragm cover 232 or the diaphragm support 233 and the diaphragm 231, to decrease a dimensional accuracy and/or an endurance of the diaphragm 231.

(2) $CO_2$ refrigerant has a relatively high working pressure, to increase thickness of the diaphragm cover 232 and the diaphragm support 233. Further, the diaphragm cover 232 and the diaphragm support 233 are made of the same kind of stainless material as the diaphragm 231 is, to be welded to the diaphragm 231. Thus, the diaphragm cover 232 and the diaphragm support 233 are not easily machined, and the diaphragm cover 232 and the diaphragm support 233 having large thicknesses cannot be processed by stamping, to raise manufacturing cost thereof.

(3) $CO_2$ refrigerant is ordinarily used in supercritical fluid phase, so that a refrigerant pressure increases as a refrigerant temperature increases. When the compressor 1 is stopped, the $CO_2$ refrigerant cooled in the gas cooler 2 does not flow especially in the temperature sensing portion 230 that is filled with the $CO_2$ refrigerant, and the $CO_2$ refrigerant in the temperature sensing portion 230 is heated up to a temperature in the engine room. Thus, the refrigerant pressure in the temperature sensing portion 230 exceeds a maximum working pressure of the refrigeration cycle. It is necessary to prevent parts of the pressure control valve 203 from scattering even if the refrigerant pressure increases beyond a strength of the temperature sensing portion 230. However, rim portions of the members 231, 232, 233 have relatively small thicknesses to secure enough melt depth, so that the strength of the temperature sensing portion 230 is small in the rim portions of the members 231, 232, 233 with respect to the strength in the other portion. Thus, a breakage of the temperature sensing portion 230 can start in the rim portions to scatter the diaphragm cover 232.

SUMMARY OF THE INVENTION

The present invention is achieved in view of the above-described issues, and has an object to provide a pressure control valve of which elements that form a temperature sensing portion (e.g. a diaphragm cover (cap member), a diaphragm, a support member (flange member)) can be easily processed, to improve accuracies of parts and to decrease manufacturing cost thereof.

Another object of the present invention is to provide a pressure control valve that is applicable to a refrigeration cycle using a refrigerant (e.g. $CO_2$ refrigerant) of which a working pressure is relatively high, and having parts compatible with uses in another kind of pressure control valve that is applicable to a refrigeration cycle using a refrigerant (e.g. HFC-134a refrigerant) of which a working pressure is relatively low, to make manufacturing equipments of the pressure control valves shareable to improve productivity of the parts.

Still another object of the present invention is to provide a pressure control valve of which a breakage of a temperature sensing portion starts in a predetermined portion, to restrict the breakage to a partial breakage to prevent the parts from scattering.

The pressure control valve for controlling a pressure of a fluid in accordance with a temperature of the fluid includes a main body, a valve body, a temperature sensing portion and a reinforcement member. The main body has a valve port and a fluid chamber in which the fluid passes. The valve body is movably installed in the main body to open and close the valve port. The temperature sensing portion is installed on the main body, and provided with a generally film-shaped diaphragm and a cap member. A peripheral portion of the diaphragm is fixed to a peripheral portion of the cap member so that one surface of the diaphragm and the cap member defines a sealed space in which a gas is airtightly filled. The other surface of the diaphragm is fixed to one end of the valve body. The other surface of the diaphragm is subjected to the fluid in the fluid chamber so that a change of the temperature of the fluid changes a volume of the gas in the sealed space to displace the diaphragm and the valve body to open and close the valve port. The reinforcement member is located on the cap member and fastened to the main body to prevent the change of the volume of the gas in the sealed space from breaking a fixture of the peripheral portion of the cap member to the peripheral portion of the diaphragm.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

Figure 1:
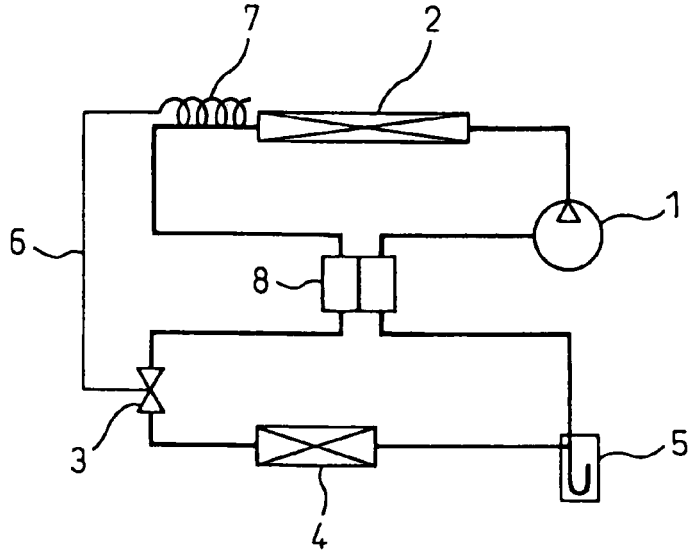
FIG. 1 is a schematic diagram showing a refrigeration cycle that includes an internal heat exchanger in which a pressure control valve according to the present invention is incorporated.

Pressure control valves according to first to ninth embodiments are described in the following, referring to the drawings.

The pressure control valves in the following embodiments are used in a refrigeration cycle (supercritical refrigeration cycle) in which carbon dioxide ($CO_2$) is used as a refrigerant. However, the pressure control valve according to the present embodiment is not limited to these usages. FIG. 1 depicts a refrigeration cycle having an internal heat exchanger, in which the refrigerant ($CO_2$) circulates. FIGS. 2-10 depict pressure control valves 3 (3A-3I) according to the embodiments of the present invention, which are applied in the refrigeration cycle shown in FIG. 1.

Figure 2:
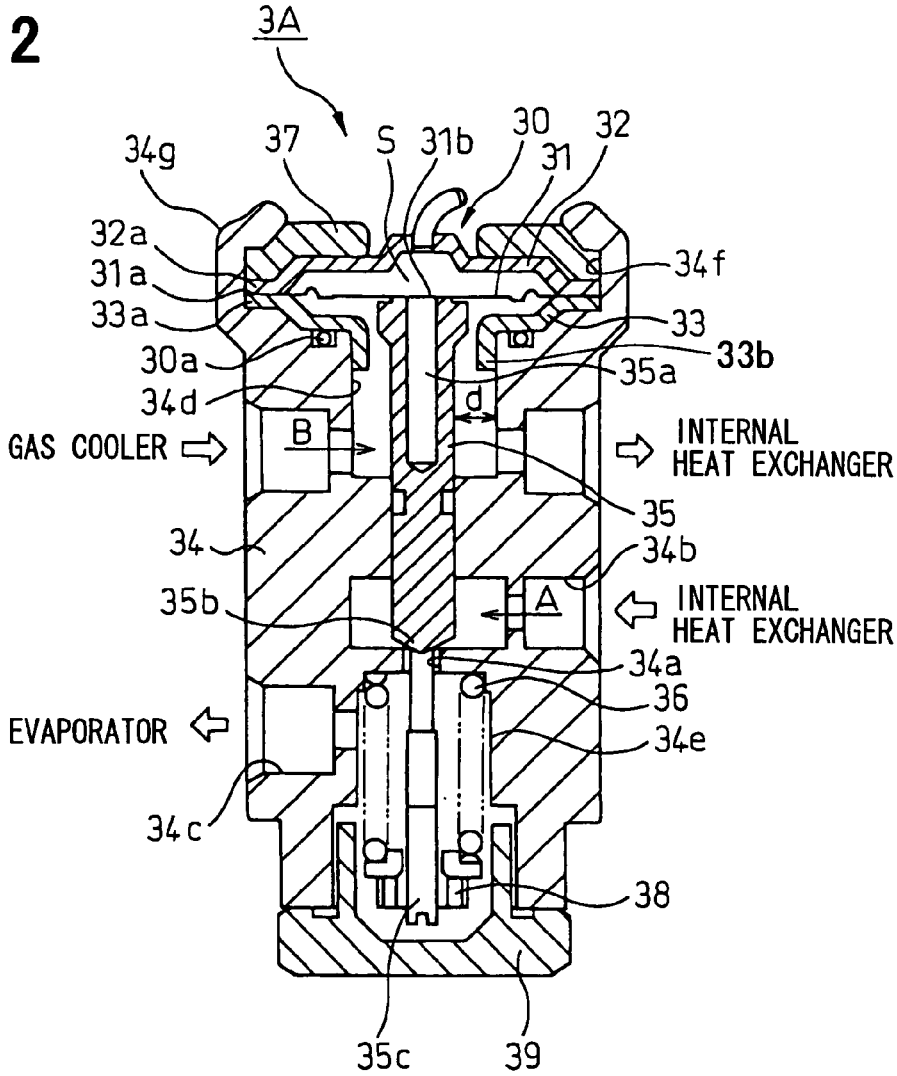
FIG. 2 is a cross-sectional view showing a pressure control valve according to a first embodiment of the present invention.

In the refrigeration cycle shown in FIG. 1, a compressor 1 sucks and compresses $CO_2$ refrigerant, which is used in a relatively high pressure condition with respect to a pressure condition in which other kind of refrigerant such as HFC refrigerant is used. A gas cooler (radiator) 2 cools the $CO_2$ refrigerant compressed by the compressor 1. The $CO_2$ refrigerant is cooled further in an internal heat exchanger 8, and flows into the pressure control valve (expansion valve) 3. The pressure control valve 3 controls a refrigerant pressure at an outlet side of the internal heat exchanger 8 in accordance with a refrigerant temperature at an outlet side of the gas cooler 2, and also serves as a pressure-reducing regulator that decreases the refrigerant pressure. A temperature sensing portion 30 of the pressure control valve 3 is located in an outlet side piping of the gas cooler 2. The pressure control valve 3 has a movable portion in which a valve body (35) is displaced in accordance with the refrigerant temperature detected by the temperature sensing portion 30 to regulate a valve opening degree. In FIG. 1, the temperature sensing portion (30) of the pressure control valve 3 is illustrated as a temperature sensing tube 7 and a capillary tube 6. In this configuration, a gas filled in the temperature sensing tube 7 and the capillary tube 6 changes its volume in accordance with a temperature of the temperature sensing tube 7. In the movable portion, a movable member such as a diaphragm (31), a bellows, etc., is displaced to move the valve body (35) to regulate the valve opening degree. That is, the valve opening degree of the refrigerant temperature is regulated by a pressure change of the gas filled in the temperature sensing tube 7. In the following embodiments, the gas filled in the temperature sensing tube 7 is $CO_2$ as same as the refrigerant circulated in refrigeration cycle shown in FIG. 1. As shown in FIG. 2, the temperature sensing portion 30 of the pressure control valve 3 is configured without the capillary tube 6.

In the refrigeration cycle shown in FIG. 1, an evaporator 4 vaporizes the $CO_2$ refrigerant, the pressure of which is reduced in the pressure control valve 3. An accumulator 5 separates gas phase $CO_2$ refrigerant from liquid phase $CO_2$ refrigerant, and temporarily reserves an excessive $CO_2$ refrigerant in the refrigeration cycle. The gas phase $CO_2$ refrigerant flows out of the accumulator 5 into the internal heat exchanger 8. Then, the gas phase $CO_2$ refrigerant is heated in the internal heat exchanger 8 and sucked into the compressor 1. The internal heat exchanger 8 is arranged in the refrigeration cycle to perform a heat exchange between the $CO_2$ refrigerant flowing from the gas cooler 2 to the pressure control valve 3 and the $CO_2$ refrigerant flowing from the accumulator 5 to the compressor 1. As such, the pressure control valve 3 is located in a refrigerant passage between the internal heat exchanger 8 and the evaporator 4. The above-mentioned components of the refrigeration cycle are connected by piping to form a closed circuit to circulate the $CO_2$ refrigerant in a sequence the compressor 1, the gas cooler 2, the internal heat exchanger 8, the pressure control valve (expansion valve) 3, the evaporator 4, the accumulator 5, the internal heat exchanger 8, and the compressor 1.

First Embodiment

The pressure control valve 3A according to the first embodiment is described in the following, referring to FIG. 2. A main body 34 of the pressure control valve 3A has: a first flow passage A, which forms a part of a refrigerant passage from the internal heat exchanger 8 via a valve port 34*a* to the evaporator 4; and a second flow passage B, which forms a refrigerant passage from the gas cooler 2 to the internal heat exchanger 8, to be separated from each other. The main body 34 further has: a refrigerant inlet 34*b* that is communicated to the internal heat exchanger 8; a refrigerant outlet 34*c* that is communicated to the evaporator 4; a first bore 34*d* in which the temperature sensing portion 30 (which is described later) is installed; and a second bore 34*e* in which an adjusting spring (coil spring) 36 is installed. A valve body 35 is installed in the main body 34 to open and close the valve port 34*a*, to allow and interrupt a communication between the internal heat exchanger 8 and the evaporator 4.

The temperature sensing portion 30 is installed the first bore 34*d* of the main body 34. The temperature sensing portion 30 includes a diaphragm 31, a cap member 32, a flange member 33 and a reinforcement member 37, to form a sealed space S therein. Specifically, a peripheral portion of a film-shaped diaphragm 31, which is formed by stamping process, is sandwiched between the cap member 32 and the flange member 33, which are formed by stamping process. Rims of these three members 31, 32, 33 are airtightly fixed to each other by welding. The reinforcement member 37 is located on the cap member 32 to cover the peripheral portion and a radially inner side of the peripheral portion, to reinforce a joint structure of the diaphragm 31, the cap member 32 and the flange member 33. The temperature sensing portion 30 is formed in this manner. The peripheral portions of the diaphragm 31, the cap member 32 and the flange member 33 are formed in flat shapes to provide peripheral flat portions 31*a*, 32*a*, 33*a*. The peripheral flat portion 31*a* is sandwiched between the peripheral flat portions 32*a*, 33*a*, and the peripheral flat portions 31*a*, 32*a*, 33*a* are joined to each other, to form the joint structure not to leave a gap therebetween.

A top end surface of the valve body 35 is fixed to the diaphragm 31 by welding, etc. so that the valve body 35 regulates the valve opening degree of the valve port 34*a* in accordance with a displacement of the diaphragm 31. The valve body 35 has a chamber 35*a* therein. The chamber 35*a* is located in a radially central portion of the valve body 35 so that the chamber 35*a* is opened to the diaphragm 35. A small hole 31*b* is formed in a radially central portion of the diaphragm 31 so as to communicate the chamber 35*a* to the sealed space S that is defined by the diaphragm 31 and the cap member 32. As such, a room in the sealed space S is extended to the chamber 35*a*. $CO_2$ gas, which is the same chemical substance as the refrigerant in the refrigeration cycle, is filled in the sealed space S and the chamber 35*a* at a predetermined pressure. Thus, the diaphragm 31 is displaced in accordance with a difference between the pressure in the sealed space S and the refrigerant pressure acting on the diaphragm 31, so that the valve body 35 regulates the valve opening degree of the valve port 34*a*.

The flange member 33 has a cylindrical portion 33*b* in a radially inner portion thereof. A screw thread is formed on an outer circumference of the cylindrical portion 33*b*, and the temperature sensing portion 30 is fixed to the main body 34 by screw-fastening the cylindrical portion 33*b* to an inner circumference of the first bore 34*d* of the main body 34. Further, the temperature sensing portion 30 is fitted to a recess 34*f* that is provided in an upper portion of the main body 34. A swaging portion 34*g* is formed integrally with the upper portion of the main body 34, and the swaging portion 34*g* is swaged radially inward so that the swaging portion 34*g* tightly fixes the temperature sensing portion 30 to the main body 34 to sandwich the reinforcement member 37 between the upper portion of the main body 34 and the swaging portion 34*g*. An O-ring 30*a* is installed between the flange member 33 of the temperature sensing portion 30 and the main body 34 to secure an airtightness of a chamber on a lower side of the diaphragm 31, which is filled with $CO_2$ refrigerant.

The valve body 35 extends in an axial direction of the pressure control valve 3A from the first bore 34*d* to the second bore 34*e*. One axial end portion (the top end surface) of the valve body 35 is fixed to the diaphragm 31 as mentioned above, and the inner circumference of the first bore 34*d* and an outer circumference of the valve body 35 define an annular space d. The annular space d is communicated to the above-mentioned second flow passage B. As such, the refrigerant pressure at the outlet side of the gas cooler 2 acts via the annular space d on the diaphragm 31. The $CO_2$ gas filled in the sealed space S of the temperature sensing portion 30 is subjected to the refrigerant temperature at the outlet side of the gas cooler 2.

The valve body 35 extends through the valve port 34*a* downward beyond the valve portion 35*b* to the other axial end portion 35*c*. An adjusting nut 38 is screw-fastened on the other end portion 35*c*. The adjusting spring (coil spring) 36 is interposed between an upper end of the second bore 34*e* on a periphery of the valve port 34*a* and the adjusting nut 38 to bias the valve body 35 in a direction to close the valve port 34*a*. By turning the adjusting nut 38, an initial load of the adjusting spring 36, i.e., a spring force when the valve port 34*a* is closed by the valve portion 35*b*, as demanded. The adjusting spring 36, the adjusting nut 38 and the other end portion 35*c* of the valve body 35 is installed in the second bore 34*e* of the main body 34, which is communicated to an inlet side of the evaporator 4. A lid 39 is fitted into the second body 34*e* of the main body 34, to close a lower end of the second bore 34*e*.

In the pressure control valve 3A having the above-described construction, a valve closing force of the valve body 35 is generated by the pressure of the $CO_2$ gas in the sealed space S in the temperature sensing portion 30 and the spring force of the adjusting spring 36. A valve opening force of the valve body 35 is generated by the refrigerant pressure at the outlet side of the gas cooler 2. The pressure control valve 3A opens and closes the valve port 34*a* in accordance with whether the above-mentioned valve opening force is larger than the valve-closing force or smaller. The pressure of the $CO_2$ gas in the sealed space S changes in accordance with the refrigerant temperature at the outlet side of the gas cooler 2, and thereby the valve opening degree of the valve port 34*a* changes, to regulate the refrigerant pressure at the outlet side of the internal heat exchanger 8.

Figure 12:
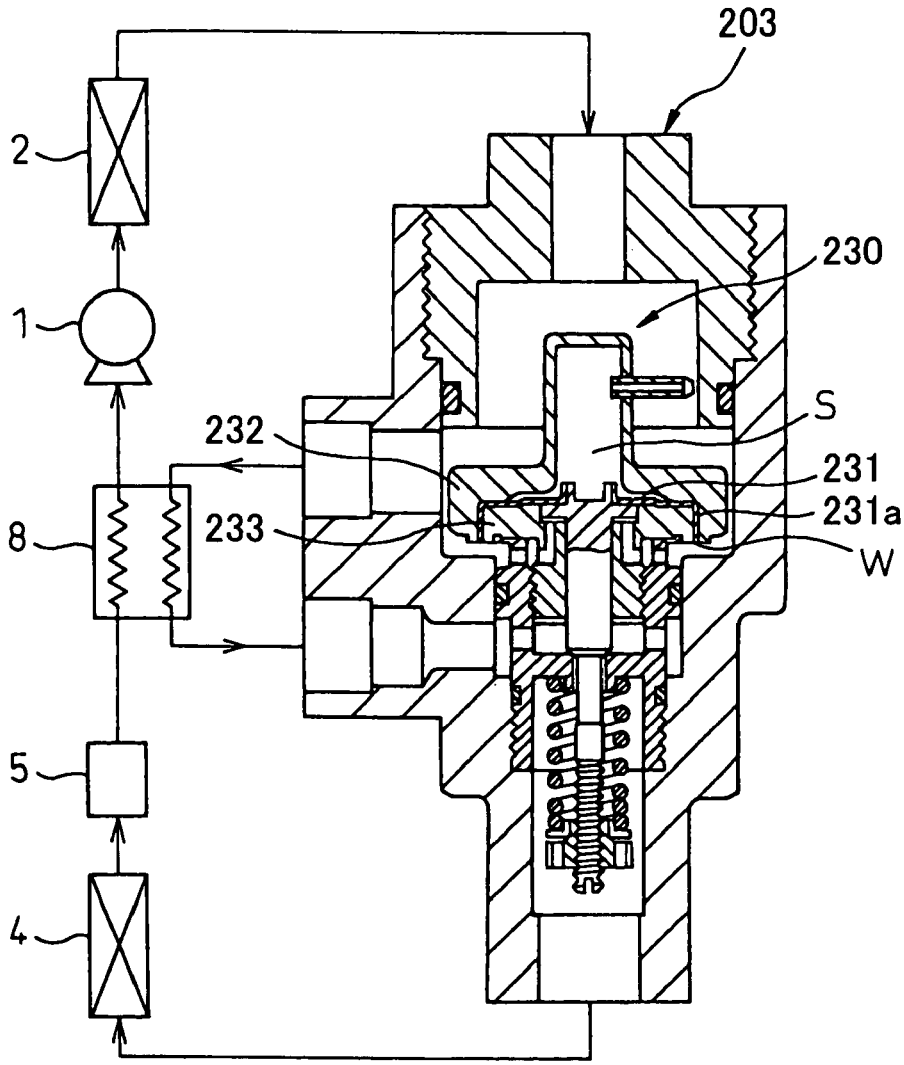
FIG. 12 PRIOR ART
FIG. 12 is a cross-sectional view showing another conventional pressure control valve.

In the pressure control valve 3A according to the first embodiment having the above-described construction, the temperature sensing portion 30 is formed by sandwiching the peripheral flat portion 31*a* of the diaphragm 31 between the peripheral flat portions 32*a*, 33*a* of the cap member 32 and the flange member 33. Further, the reinforcement member 37 tightly holds the joint structure of the diaphragm 31, the cap member 32 and the flange member 33, and the radially inner side of the joint structure, and the swaging portion 34*g* of the main body 34 is swaged radially inward to tightly fix the diaphragm 31, the cap member 32, the flange member 33 and the reinforcement member 37 to the main body 34. Accordingly, it is not necessary to bend the peripheral portion of the diaphragm 31 as in the conventional pressure control valve 203 shown in FIG. 12. Thus, the diaphragm 31 can be easily processed even if the diaphragm 31 is made of relatively hard stainless steel, and it is possible to easily secure an accuracy of flatness of the peripheral flat portion 31*a*, which is fixed to the cap member 32 and to the flange member 33.

Figure 11:
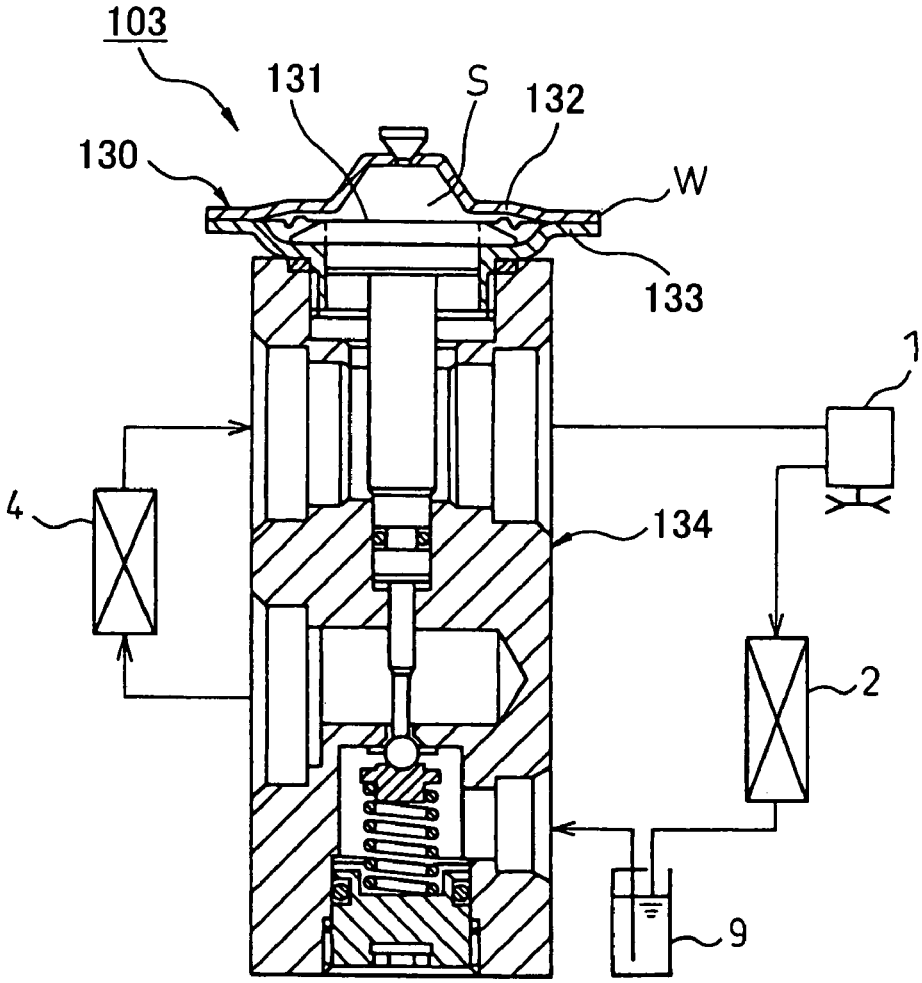
FIG. 11 PRIOR ART
FIG. 11 is a cross-sectional view showing a conventional pressure control valve.

Further, the pressure control valve 3A is provided with the reinforcement member 37. Thus, it is possible to form the cap member 32 and the flange member 33 in a thicknesses as small as the cap member 132 and the flange member 133 of the temperature sensing portion 130 in the conventional pressure control valve 103 shown in FIG. 11, which is applicable to a usage in a refrigeration cycle using HFC-134a refrigerant. Accordingly, it is easy to form the cap member 32 and the flange member 33 by stamping process, so that the cap member 32 and the flange member 33 can be processed by using a manufacturing equipment substantially as same as a manufacturing equipment for processing parts of the temperature sensing portion of conventional pressure control valve for the refrigeration cycle using HFC-134a refrigerant. This serves to improve productivity of the parts and to decrease manufacturing cost.

Furthermore, differences between thicknesses of the diaphragm 31, the cap member 32 and the flange member 33 are small, to be easily welded to each other. The diaphragm 31, the cap member 32 and the flange member 33 can be welded to each other at their rims as those in the conventional pressure control valve for HFC-134a refrigerant. Also this serves to improve productivity of the parts and to decrease manufacturing cost.

Still further, the reinforcement member 37, which is for securing enough strength to endure the refrigerant pressure, is separated from the temperature sensing portion 30. Thus, the reinforcement member 37 can be made of a material that is easily processed and has a low cost, such as steel.

Second Embodiment

Figure 3:
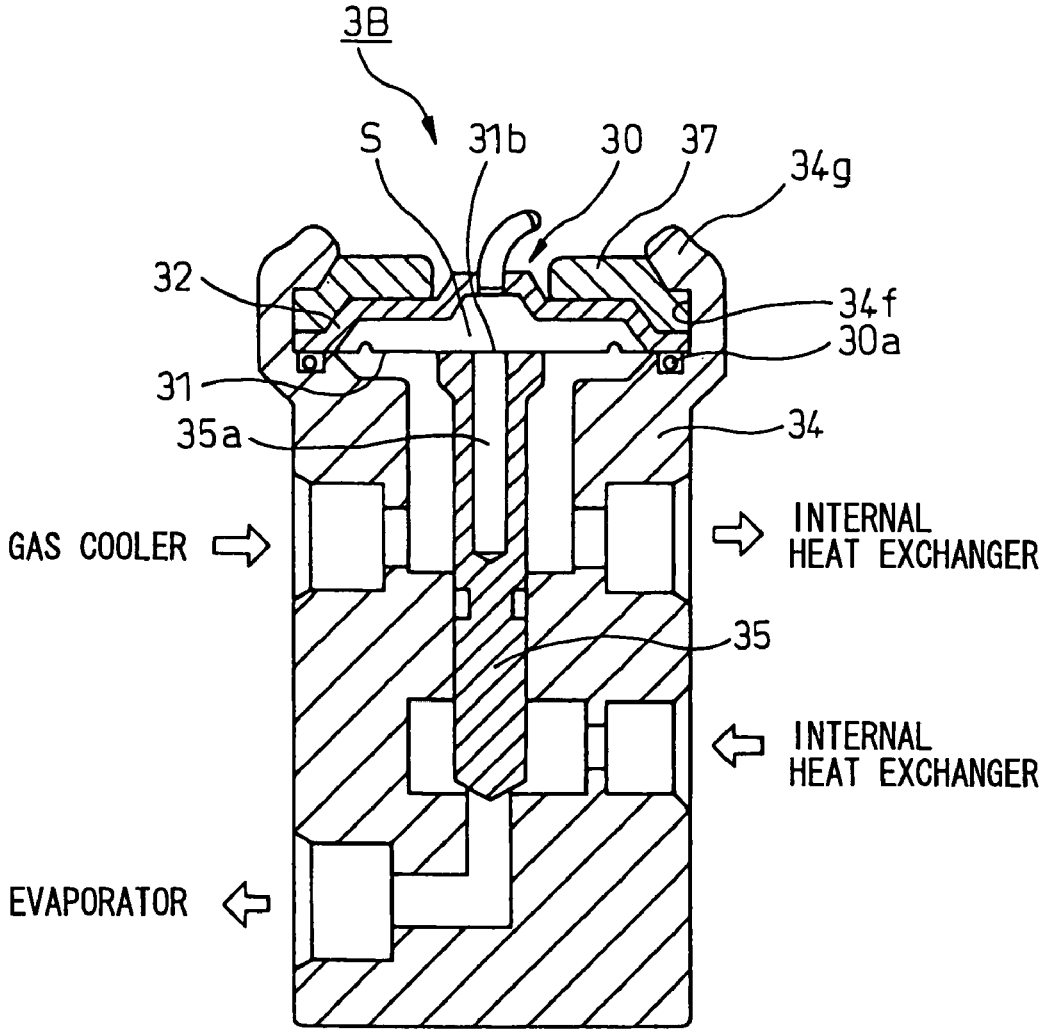
FIG. 3 is a cross-sectional view showing a pressure control valve according to a second embodiment of the present invention.

FIG. 3 depicts the pressure control valve 3B according to the second embodiment. In the pressure control valve 3B according to the second embodiment, the temperature sensing portion 30 does not include the flange member 33, which is provided in the pressure control valve 3A according to the first embodiment shown in FIG. 2. Specifically, in the pressure control valve 3B, the peripheral flat portion 31*a* of the diaphragm 31 and the peripheral flat portion 32*a* of the cap member 32 are put on each other and the rims of the peripheral flat portions 31*a*, 32*a* are welded to each other. The reinforcement member 37 is arranged to cover the peripheral flat portions 31*a*, 32*a* and a radially inner side of the peripheral flat portions 31*a*, 32*a*, to form the temperature sensing portion 30. As such, in the pressure control valve 3B, a lower end surface of the recess 34*f* of the main body 34 serves substantially as same as the peripheral flat portion 33*a* of the flange member 33 in the pressure control valve 3A according to the first embodiment. An O-ring 30*a* is installed between the diaphragm 31 of the temperature sensing portion 30 and the main body 34 to secure the airtightness of the chamber on the lower side of the diaphragm 31, which is filled with $CO_2$ refrigerant. The temperature sensing portion 30 having the above-described construction is fitted to the recess 34*f* of the main body 34 in an analogous fashion to the first embodiment. The swaging portion 34*g* is swaged radially inward to fix the temperature sensing portion 30 to the main body 34 so that the reinforcement member 37 applies a compressive force onto the rims of the peripheral flat portions 31*a*, 32*a*, which are welded to each other.

In the pressure control valve 3B according to the second embodiment, a predetermined amount of $CO_2$ gas and a predetermined amount of inactive gas (e.g. $N_2$, He) are filled in the sealed space S, to thereby leave out the adjusting spring 36 and other parts accompanied with the adjusting spring 36 (e.g. adjusting nut 38), which are provided to bias the valve body 35 in a direction to close the valve port 34*a*. Thus, one axial end of the valve body 35, which is opposite from the temperature sensing portion 30, is closed. The construction of the temperature sensing portion 30 of the pressure control valve 3B according to the second embodiment can be applied to pressure control valves having the adjusting spring 36, etc., such as the pressure control valve 3A according to the first embodiment. It is possible to provide the pressure control valve according to the present invention with both of the inactive gas filled in the sealed space S and the adjusting spring 36, to bias the valve body 35 to close the valve port 34*a*.

The other portions of the pressure control valve 3B according to the second embodiment have substantially the same construction as those of the pressure control valve 3A according to the first embodiment, and not described hereby.

Third Embodiment

Figure 4:
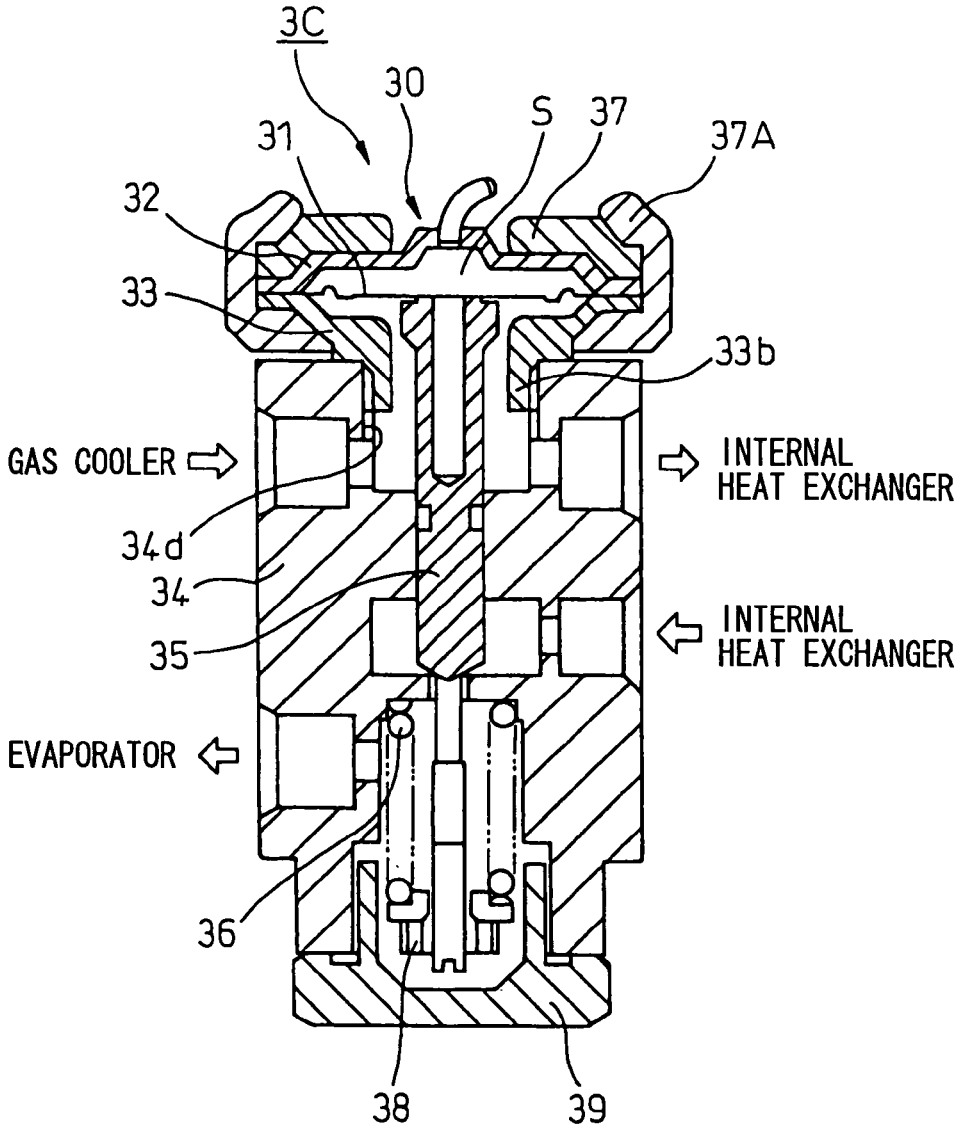
FIG. 4 is a cross-sectional view showing a pressure control valve according to a third embodiment of the present invention.

FIG. 4 depicts the pressure control valve 3C according to the third embodiment. The pressure control valve 3C according to the third embodiment has a second reinforcement member 37A, which is a part separately formed from the main body 34, and corresponds to the recess 34*f* and the swaging portion 34*g* of the main body 34 of the pressure control valve 3A according to the first embodiment. That is, peripheral portions of four members of the flange member 33, the diaphragm 31, the cap member 32 and the reinforcement member 37 of the temperature sensing portion 30, in which a joint structure of the four members is formed, is fitted into a recess of the second reinforcement member 37A. Then, a swaging portion of the second reinforcement member 37A is swaged radially inward as shown in FIG. 4, to have a generally U-shaped cross-section, to reinforce the joint structure of the temperature sensing portion 30. A screw thread is formed on the outer circumference of the cylindrical portion 33*b*, and the temperature sensing portion 30 having the above-described construction is fixed to the main body 34 by screw-fastening the cylindrical portion 33*b* to an inner circumference of the first bore 34*d* of the main body 34. A gasket (not shown), which is sandwiched between the main body 34 and the flange member 33, and substantially as same as the O-ring 30*a* in the first and second embodiments, secures the airtightness of the chamber on the lower side of the diaphragm 31, which is filled with $CO_2$ refrigerant. The other portions of the pressure control valve 3C according to the third embodiment have substantially the same construction as those of the pressure control valve 3A according to the first embodiment, and not described hereby.

Fourth Embodiment

Figure 5:
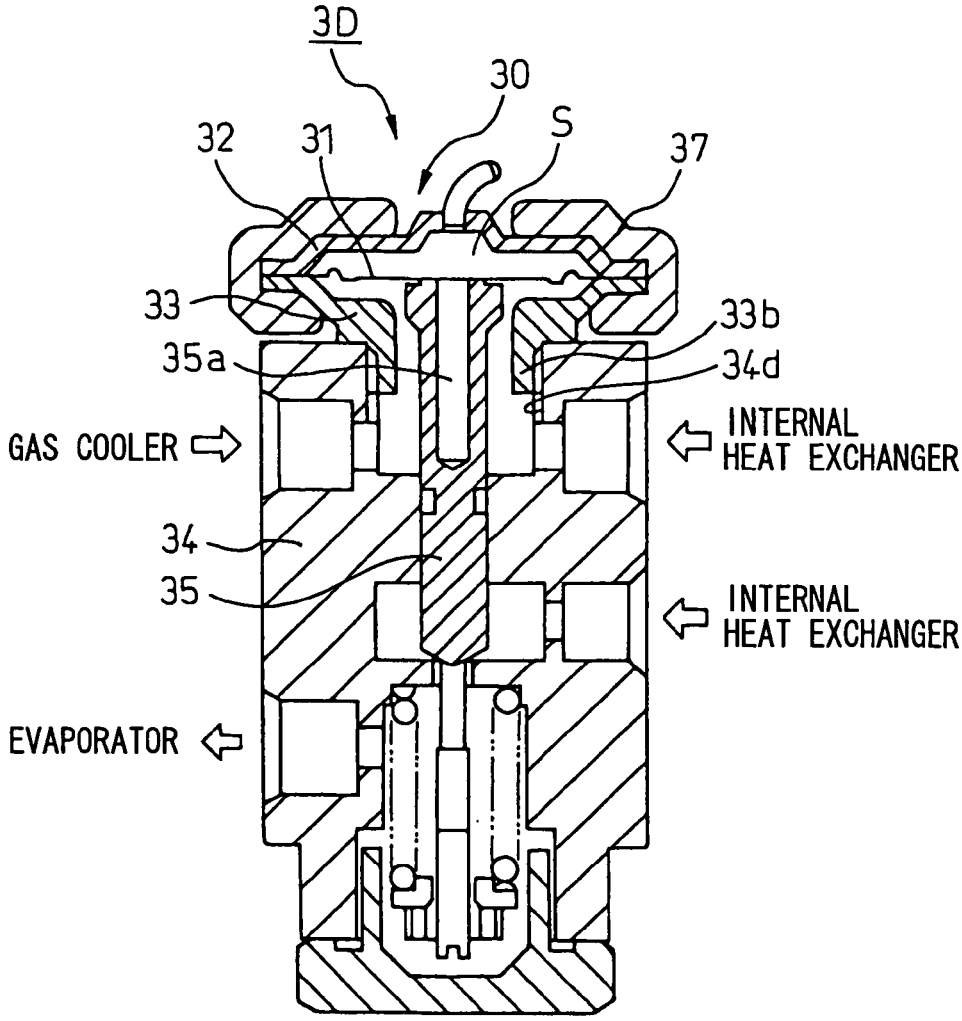
FIG. 5 is a cross-sectional view showing a pressure control valve according to a fourth embodiment of the present invention.

FIG. 5 depicts the pressure control valve 3D according to the fourth embodiment. The pressure control valve 3C according to the fourth embodiment has a reinforcement member 37 having a single-piece construction that includes the reinforcement member 37 mainly for reinforcing the cap member 32 and the second reinforcing member 37A mainly for reinforcing the peripheral portion of the temperature sensing portion 30, which are separately provided in the third embodiment, so as to reduce the number of parts. As such, the reinforcement member 37 in the fourth embodiment covers an upper surface of the cap member 32 from the peripheral portion to the radially inner side of the peripheral portion, and the joint structure of the temperature sensing portion 30 from its lower surface to its upper surface in a U-shaped manner. The other portions of the pressure control valve 3D according to the fourth embodiment have substantially the same construction as those of the pressure control valve 3C according to the third embodiment, and not described hereby.

Fifth Embodiment

Figure 6:
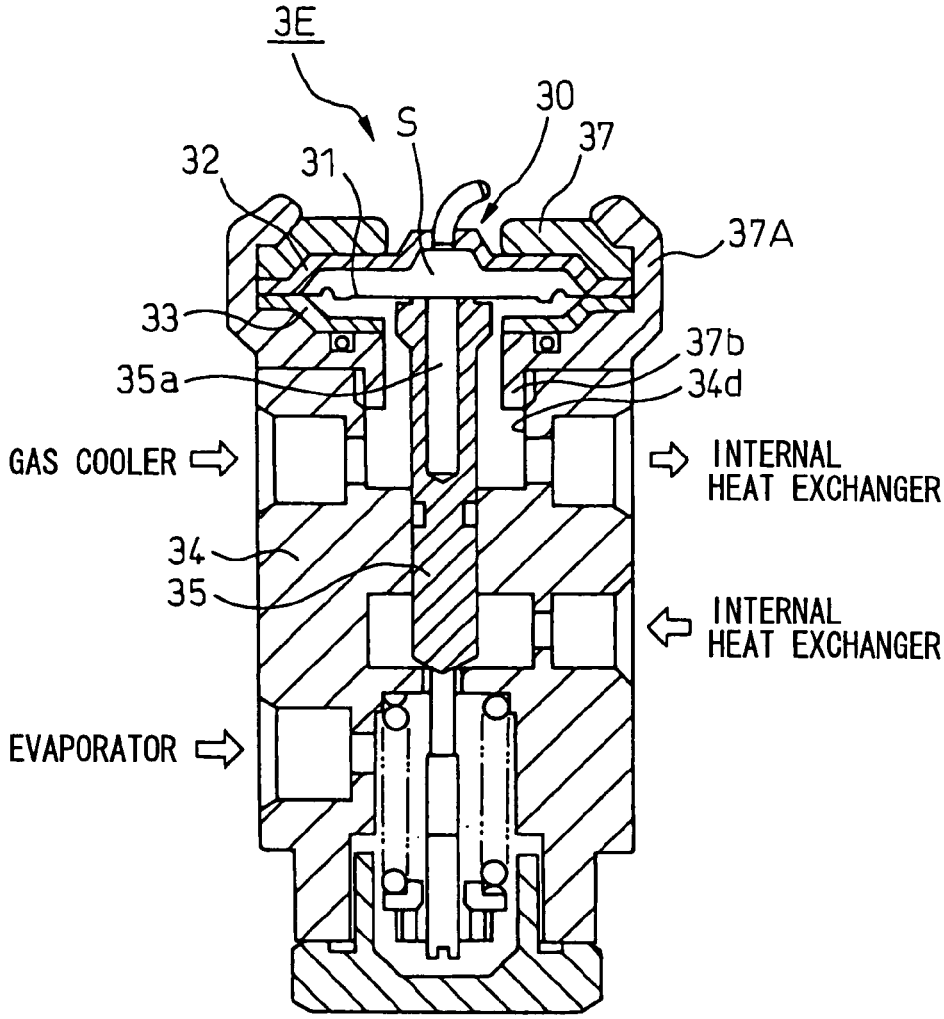
FIG. 6 is a cross-sectional view showing a pressure control valve according to a fifth embodiment of the present invention.

FIG. 6 depicts the pressure control valve 3E according to the fifth embodiment. In the fifth embodiment, the second reinforcement member 37A, which is a part separately formed from the main body 34, corresponds to the recess 34*f* and the swaging portion of the main body 34 in the first embodiment. Thus, a construction of the second reinforcement member 37A in the fifth embodiment is partially different from a construction of the second reinforcement member 37A in the third embodiment. In the third embodiment, the temperature sensing portion 30 is fixed to the main body 34 by screw-fastening the cylindrical portion 33*b* of the flange member 33 to the first bore 34*d* of the main body 34. In this regard, the second reinforcement member 37A in the fifth embodiment is provided with a cylindrical portion 37*b* in a radially inner portion thereof, and a screw thread is formed on an outer circumference of the cylindrical portion 37*a*. Then, the temperature sensing portion 30 is fixed to the main body 34 by screw-fastening the cylindrical portion 37*b* to the inner circumference of the first bore 34*d* of the main body 34. Thus, the flange member 33 in the fifth embodiment is not provided with the cylindrical portion 33*b*. A gasket (not shown), which is sandwiched between the main body 34 and the second reinforcement member 37A, secures the airtightness of the chamber on the lower side of the diaphragm 31, which is filled with $CO_2$ refrigerant. The other portions of the pressure control valve 3E according to the fifth embodiment have substantially the same construction as those of the pressure control valve 3C according to the third embodiment, and not described hereby.

Sixth Embodiment

Figure 7A:
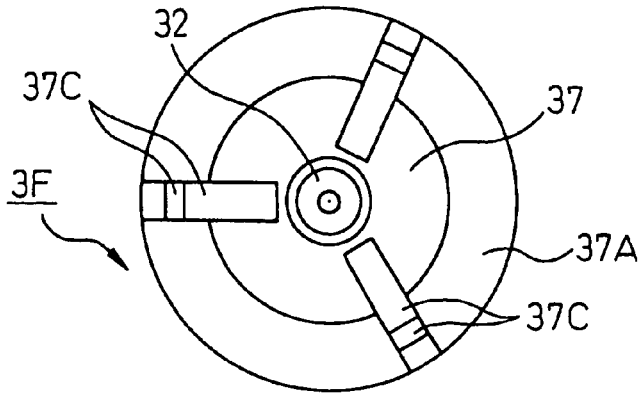
FIGS. 7A, 7B are a top view and a cross-sectional view showing a pressure control valve according to a sixth embodiment of the present invention.
Figure 7B:
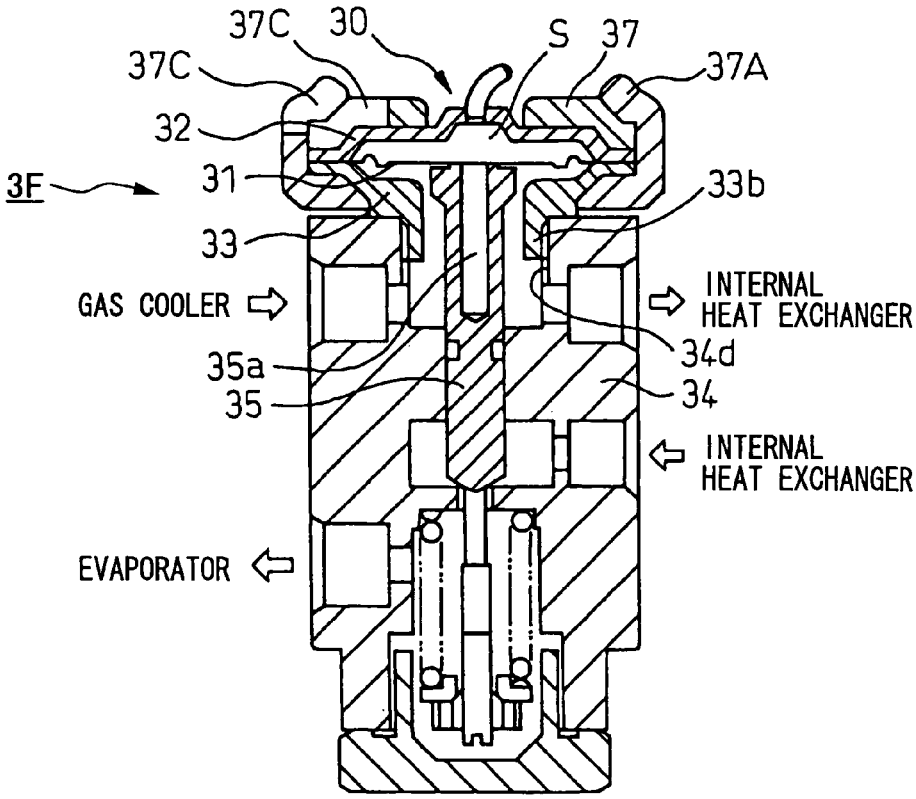

FIGS. 7A, 7B depict the pressure control valve 3F according to the sixth embodiment. A construction of the temperature sensing portion 30 in the sixth embodiment is substantially the same as the construction of the temperature sensing portion 30 in the third embodiment, except for the following point. In the third embodiment, thicknesses of the reinforcement member 37 and the second reinforcement member 37A are respectively constant over an entire circumference of the temperature sensing portion 30. In this regard, the reinforcement member 37 and the second reinforcement member 37 in the sixth embodiment respectively have a plurality of slit portions 37*c* (three slit portions 37*c* in FIGS. 7A, 7B) that are arranged at intervals along the circumference of the temperature sensing portion 30. The slit portions 37*c* provides portions in which strengths of the reinforcement member 37 and the second reinforcement member 37A are smaller than strengths in the other portions of the reinforcement member 37 and the second reinforcement member 37A. The other portions of the pressure control valve 3F according to the sixth embodiment have substantially the same construction as those of the pressure control valve 3C according to the third embodiment, and not described hereby.

When the temperature sensing portion 30 is subjected to an excessively large force to generate a crack in the welded joint structure of the temperature sensing portion 30, a welded joint structure of the diaphragm 31, the cap member 32 and the flange member 33 firstly breaks in the slit portions 37*c*, by providing the reinforcement member 37 and the second reinforcement member 37A with portions in which the reinforcement member 37 and the second reinforcement member 37A have strengths smaller than in the other portions. Thus, the gas in the sealed space S starts leaking in the slit portions 37*c*. As such, it is possible to prevent parts of the pressure control valve 3F such as the cap member 32, the reinforcement member 37 and the second reinforcement member 37A from scattering.

Seventh Embodiment

Figure 8A:
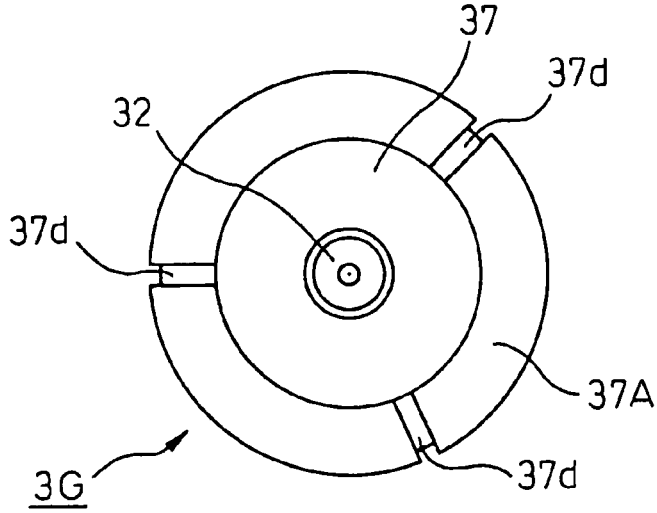
FIGS. 8A, 8B are a top view and a cross-sectional view showing a pressure control valve according to a seventh embodiment of the present invention.
Figure 8B:
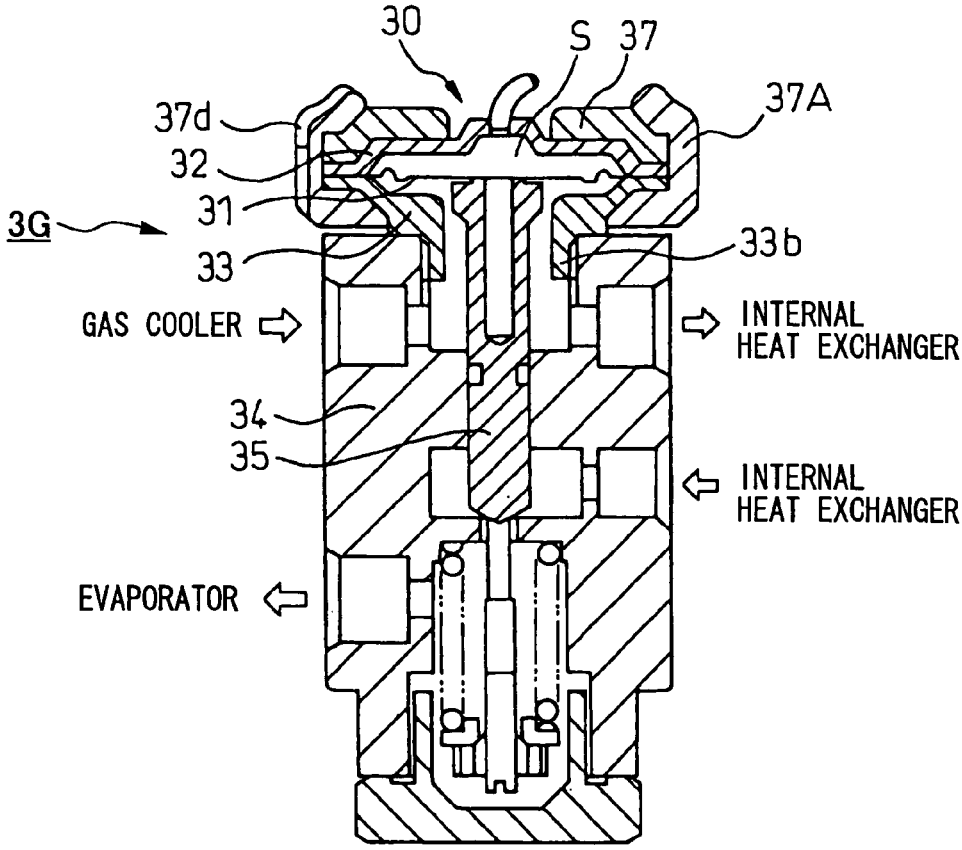

FIGS. 8A, 8B depict the pressure control valve 3G according to the seventh embodiment. A construction of the temperature sensing portion 30 in the seventh embodiment is substantially the same as the construction of the temperature sensing portion 30 in the third embodiment, except for the following point. In the third embodiment, thickness of the second reinforcement member 37A is constant over an entire circumference of the temperature sensing portion 30. In this regard, the second reinforcement member 37A in the seventh embodiment has a plurality of thin-walled portions 37*d* (three thin-walled portions 37*c* in FIGS. 8A, 8B) that are arranged at intervals along the circumference of the temperature sensing portion 30. The other portions of the pressure control valve 3G according to the seventh embodiment have substantially the same construction as those of the pressure control valve 3C according to the third embodiment, and not described hereby.

When the temperature sensing portion 30 is subjected to an excessively large force, the cap member 32 is deformed to open the swaging portion. By providing the second reinforcement member 37A with the thin-walled portions 37*d* that are more easily deformed than in the other portions, it is possible to prevent the deformation of the swaging portion from extending to an entire circumference of the second reinforcement member 37A. As such, parts of the pressure control valve 3G from scattering.

Eighth Embodiment

Figure 9C:
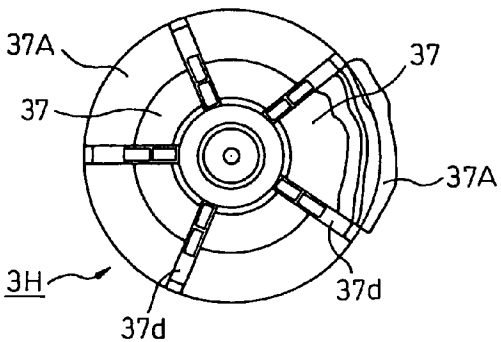
FIGS. 9C, 9D are a top view and a cross-sectional view showing an action of the pressure control valve according to the eighth embodiment.
Figure 9A:
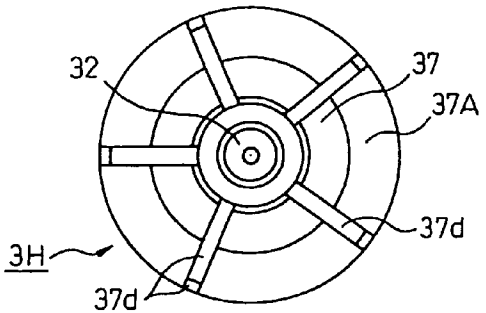
FIGS. 9A, 9B are a top view and a cross-sectional view showing a pressure control valve according to an eighth embodiment of the present invention.
Figure 9D:
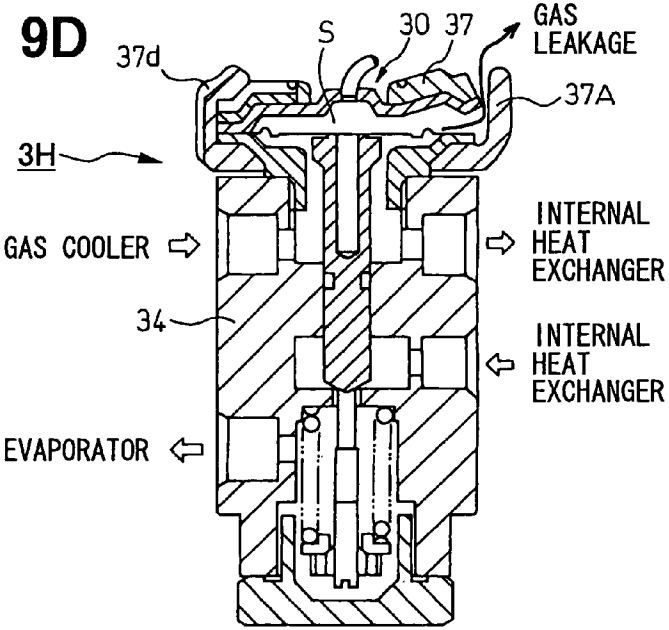
Figure 9B:
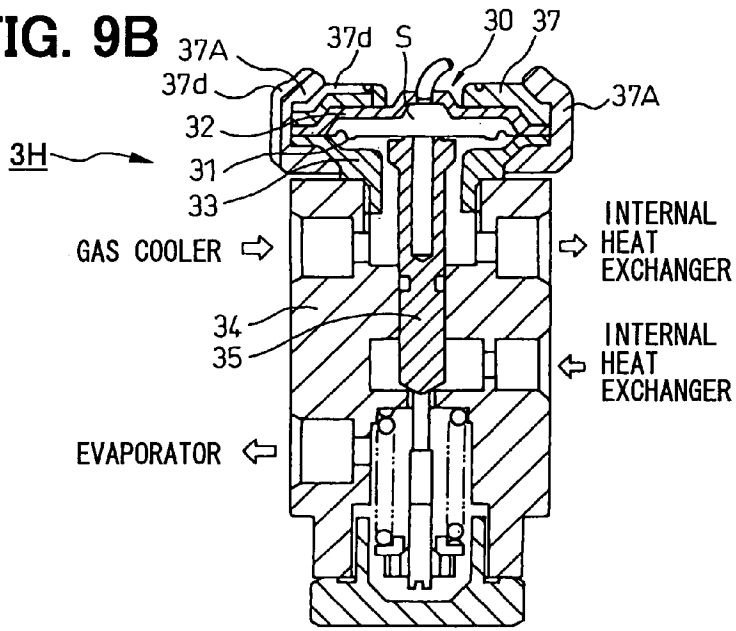

FIGS. 9A-9D depict the pressure control valve 3H according to the eighth embodiment. FIGS. 9C, 9D depict an action of the pressure control valve 3H according to the eighth embodiment. A construction of the temperature sensing portion 30 in the eighth embodiment is substantially the same as the construction of the temperature sensing portion 30 in the third embodiment, except for the following point. In the third embodiment, thicknesses of the reinforcement member 37 and the second reinforcement member 37A are respectively constant over an entire circumference of the temperature sensing portion 30. In this regard, the reinforcement member 37 and the second reinforcement member 37A in the eighth embodiment respectively have a plurality of thin-walled portions 37*d* (five slit portions 37*d* in FIGS. 9A-9D) that are arranged at intervals along the circumference of the temperature sensing portion 30. The other portions of the pressure control valve 3H according to the eighth embodiment have substantially the same construction as those of the pressure control valve 3C according to the third embodiment, and not described hereby.

As shown in FIGS. 9C, 9D, when the pressure in the sealed space S increases to apply an excessively large force to the temperature sensing portion 30, the swaging portion of the second reinforcement member 37A is deformed to open, the reinforcement member 37, which reinforces the cap member 32, is deformed in a portion between the thin-walled portions 37*d* prior to the other portions, to prevent the deformation of the swaging portion from extending an entire circumference of the second reinforcement member 37A. As such, parts of the pressure control valve 3H from scattering. FIGS. 9C, 9D illustrate a condition when the swaging portion of the second reinforcement member 37A is deformed to open, to leak the gas in the sealed space S of the temperature sensing portion 30. In the eighth embodiment, the reinforcement member 37 and the second reinforcement member 37A are provided with the thin-walled portions 37*d* having relatively small strengths, so that the gas leaks only in the portion between a couple of the thin-walled portions 37*d* as shown in FIGS. 9C, 9D. As a result, the deformation of the swaging portion do not extend over the entire circumference of the second reinforcement member 37A, to prevent the parts of the pressure control valve 3H such as the cap member 32 and the reinforcement member 37 from scattering.

Each of the above-described pressure control valves 3F-3H according to the sixth to eighth embodiments has the temperature sensing portion 30 that has basically the same construction as the construction of the temperature sensing portion 30 in the third embodiment, except for the reinforcement member 37 and/or the second reinforcement member 37A. In this regard, the construction of the temperature sensing portion 30, which is provided with slit portions 37*c* and/or the thin-walled portions 37*d* that have smaller strengths than the strengths of the other portions, can be applied to the constructions of the temperature sensing portions 30 in the first, second, fourth and fifth embodiments. The temperature sensing portions 30 in the sixth to eighth embodiments has the slit portions 37*c* and/or the thin-walled portions 37*d* that have strengths relatively smaller than the other portions. Alternatively, it is also possible to realize the temperature sensing portion 30 with portions having relatively small strengths, for example, by providing the reinforcement portion 37 and/or the second reinforcement portion 37A with depressed portions, portions having relatively small cross-sectional area etc., or providing the swaging portions partially with a portion having a relatively small cross-sectional area.

Ninth Embodiment

Figure 10:
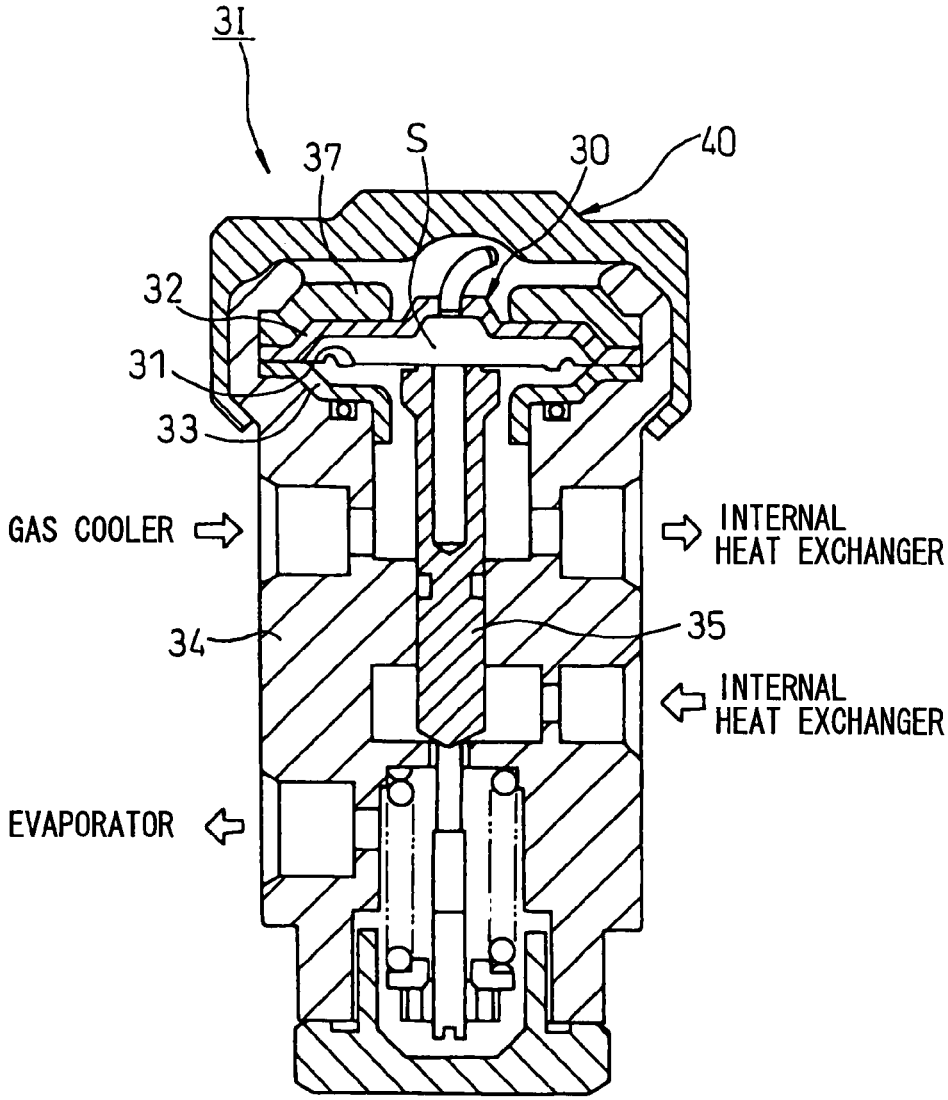
FIG. 10 is a cross-sectional view showing a pressure control valve according to a ninth embodiment of the present invention.

FIG. 10 depicts the pressure control valve 3I according to the ninth embodiment. A construction of the pressure control valve 3I in the ninth embodiment is substantially the same as the construction of the pressure control valve 3A in the first embodiment, which is shown in FIG. 2, except for the following point. The pressure control valve 3I in the ninth embodiment is provided with a cover 40 that covers the reinforcement member 37, in addition to the construction of the pressure control valve 3A according to the first embodiment shown in FIG. 2. The other portions of the pressure control valve 3I according to the ninth embodiment have substantially the same construction as those of the pressure control valve 3A according to the first embodiment, and not described hereby. The pressure control valve is installed in an engine room to regulate the refrigerant pressure at the outlet side of the gas cooler 2. In this regard, an atmospheric temperature in the engine room is ordinarily larger than the refrigerant temperature. Thus, the refrigerant temperature cannot be detected with accuracy when the atmospheric temperature in the engine room heats the temperature sensing portion 30. Further, the pressure control valve is installed normally to place the temperature sensing portion 30 vertically up. Thus, splashed water can remain in a dent portion radially inside the reinforcement member 37, so that the temperature sensing portion 30 is cooled down to make it impossible to detect the refrigerant temperature with accuracy. Further, the water remaining in the dent portion inside the reinforcement member 37 can cause corrosion.

In this regard, the pressure control valve 3I according to the ninth embodiment is provided with the cover 40, which is made of rubber, resin and the like, to cover the dent portion to insulate the temperature sensing portion 30 and to prevent an entry of splashed water.

This description of the invention is merely exemplary in nature and, thus, variations that do not depart from the gist of the invention are intended to be within the scope of the invention. Such variations are not to be regarded as a departure from the spirit and scope of the invention.

What is claimed is:

1. A pressure control valve for controlling a pressure of a fluid in accordance with a temperature of the fluid, the pressure control valve comprising:

a main body that has a valve port and a fluid chamber in which the fluid passes;

a valve body that is movably installed in the main body to open and close the valve port; and a temperature sensing portion that is installed on the main body, and provided with a generally film-shaped diaphragm and a cap member, a peripheral portion of the diaphragm being fixed to a peripheral portion of the cap member so that a first surface of the diaphragm and a first surface of the cap member define a sealed space in which a gas is airtightly filled, a second surface of the diaphragm opposite to the first surface of the diaphragm being fixed to one end of the valve body, and the second surface of the diaphragm being subjected to the fluid in the fluid chamber so that a change of temperature of the fluid changes a volume of the gas in the sealed space to displace the diaphragm and the valve body to open and close the valve port; and a reinforcement member that is in direction contact with a second surface of the cap member opposite to the first surface of the cap member and fastened to the main body to prevent the change of the volume of the gas in the sealed space from breaking a fixture of the peripheral portion of the cap member to the peripheral portion of the diaphragm.

2. The pressure control valve according to claim 1, wherein the peripheral portion of diaphragm has a generally flat profile.

3. The pressure control valve according to claim 2, wherein:

the peripheral portion of the cap member has a generally flat profile; and the peripheral portion of the diaphragm and the peripheral portion of the cap member are put on each other and airtightly welded to each other.

4. The pressure control valve according to claim 1, wherein the reinforcement member is fastened to the main body to apply a compressive force to the peripheral portions of the diaphragm and the cap member to reinforce the fixture of the peripheral portion of the cap member to the peripheral portion of the diaphragm.

5. The pressure control valve according to claim 1, wherein the reinforcement member covers an entire circumference of the peripheral portion of the cap member to prevent the peripheral portions of the diaphragm and the cap member from deforming.

6. The pressure control valve according to claim 1, wherein:

the temperature sensing portion is further provided with a generally annular flange member, a peripheral portion of the flange member being fixed to the peripheral portion of the diaphragm so that the cap member and the flange member sandwich the diaphragm therebetween; and the reinforcement member is fastened to the main body so that the main body and the reinforcement member surround the peripheral portions of the diaphragm, the cap member and the flange member, and a radially inner side of the peripheral portions.

7. The pressure control valve according to claim 6, wherein:

the peripheral portion of diaphragm has a generally flat profile;

the peripheral portion of the cap member has a generally flat profile;

the peripheral portion of the flange member has a generally flat profile; and the peripheral portion of the cap member and the peripheral portion of the flange member are put on both sides of the peripheral portion of the diaphragm; and the peripheral portions of the diaphragm, the cap member and the flange member are welded to each other.

8. The pressure control valve according to claim 6, wherein the reinforcement member is fastened by any one of swaging, screw-fastening and welding to the main body to apply a compressive force to the peripheral portions of the diaphragm, the cap member and the flange member to reinforce fixtures of the peripheral portions of the cap member and the flange member to the peripheral portion of the diaphragm.

9. The pressure control valve according to claim 6, wherein the reinforcement member is in intimate contacts with the cap member and the flange member, and covers most surfaces of the cap member and the flange member to prevent the peripheral portions of the diaphragm, the cap member and the flange member from deforming.

10. The pressure control valve according to claim 1, wherein the reinforcement member is provided with a deformation-inducing portion in which the reinforcement member has a strength smaller than in a portion other than the deformation-inducing portion.

11. The pressure control valve according to claim 10, wherein the deformation-inducing portion includes at least one of a slit, a thin-walled portion and a thin-walled swaging portion.

12. The pressure control valve according to claim 1, wherein:

the fluid is a refrigerant of a vapor-compression refrigeration cycle;

the valve port is locate don a fluid path from an internal heat exchanger to an evaporator of vapor-compression refrigeration cycle; and the fluid chamber is located on an outlet side of a gas cooler of the vapor-compression refrigeration cycle so that the valve body opens and closes the valve port in accordance with the temperature of the refrigerant on the outlet side of the gas cooler.

13. The pressure control valve according to claim 1, wherein the reinforcement portion has a contact surface that is in contact with the second surface of the cap member to secure the cap member and the diaphragm to the main body.

* * * * *